US006889643B2

(12) United States Patent
Motohashi

(10) Patent No.: US 6,889,643 B2
(45) Date of Patent: May 10, 2005

(54) ROCKER ARM AND MANUFACTURING METHOD THEREOF

(75) Inventor: Nobutsuna Motohashi, Tokyo (JP)

(73) Assignee: Koyo Seiko Co., Ltd., Osaka (JP)

( * ) Notice: Subject to any disclaimer, the term of this patent is extended or adjusted under 35 U.S.C. 154(b) by 0 days.

(21) Appl. No.: 10/602,775

(22) Filed: Jun. 25, 2003

(65) Prior Publication Data

US 2004/0000278 A1 Jan. 1, 2004

(30) Foreign Application Priority Data

Jun. 26, 2002 (JP) ..... P. 2002-185578

(51) Int. Cl.[7] ..... F01L 1/18
(52) U.S. Cl. ..... 123/90.39; 29/888.2; 123/90.16
(58) Field of Search ..... 123/90.15–90.18, 123/90.39–90.47; 29/888.2; 74/569

(56) References Cited

U.S. PATENT DOCUMENTS 4,803,766 A * 2/1989 Akao et al. ..... 29/888.2
5,535,641 A * 7/1996 Uchida et al. ..... 74/559
5,946,800 A * 9/1999 Daigo ..... 29/888.2

FOREIGN PATENT DOCUMENTS

| | | |
|---|---|---|
| DE | 100 30 341 A1 | 1/2002 |
| EP | 1 122 408 A1 | 8/2001 |
| JP | 7-155888 | 6/1995 |
| JP | 2001-191139 | 7/2001 |
| JP | 2001-198641 | 7/2001 |
| JP | 2001-271615 | 10/2001 |

* cited by examiner

*Primary Examiner*—Thomas Denion
*Assistant Examiner*—Jaime Corrigan
(74) *Attorney, Agent, or Firm*—McGinn & Gibb, PLLC

(57) ABSTRACT

A gap (34) for forming an excess thickness portion is provided between a pair of first dies (26, 27) and a intermediate portion (32) of the second die (24), and an excess thickness portion (35) is formed in bottom portions of the valve guide walls (28, 29) of valve guide walls.

20 Claims, 7 Drawing Sheets

ROCKER ARM AND MANUFACTURING METHOD THEREOF

BACKGROUND OF THE INVENTION

The present invention relates to a rocker arm and a manufacturing method thereof.

In general, the rocker arm includes a body and a roller pivotally attached to the body through a support shaft. The body includes a pair of side walls opposed to each other in the axial direction and a pair of connecting walls for connecting the side walls with each other at both end portions of the side walls in the longitudinal direction.

The valve engaging portion is constituted by valve guide walls, which are arranged at one end side of the side walls in the longitudinal direction, and a connecting wall arranged on one end side for connecting both the valve guide walls. The pivot receiving portion for receiving an upper end portion of the lash adjuster is formed on the connecting wall on the other end side of the side walls in the longitudinal direction.

The body of the above rocker arm is manufactured by means of press forming in some cases. Concerning the procedure of manufacturing the body, one metallic sheet is punched by means of press forming so as to form it into a metallic sheet member having a predetermined shape. Then, this metallic sheet member is folded and formed into a substantial U-shape as shown in FIG. 11. After that, in this U-shaped metallic sheet member, a valve engaging portion is formed by using the die 50 having a predetermined shape. This die 50 is integrally formed to have a recess portion 53 into which a pair of side walls 51, which are opposed to each other, and the connecting walls 52 are inserted.

In the case of forming the valve engaging portion by using the integral die 50 described above, there is a possibility that stress concentration is caused in the corner angle portion 53*a* of the recess portion 53 when the die 50 is given a force. Therefore, cracks tend to occur in the die 50 originating at the corner angle portion 53*a* of the recess portion 53.

Therefore, it can be considered that the die 50 is divided as shown in FIG. 12. This die 50 includes: a pair of outer dies 55 to push the side walls 51 laterally; and an inner die 56, separated from these outer dies 55, to form the connecting wall 52 between the outer dies 55 and the inner die 56. These outer dies 55 and the inner die 56 are divided on the dividing lines 57 that is formed at a portion corresponding to the corner angle portion of the side wall 51. According to the above constitution, it is possible to prevent the occurrence of cracks in the die 50.

However, in the case where the die 50 is divided into the outer dies 55 and inner die 56 as described above, when a force is given to the outer dies 55 and inner die 56, there is a tendency that both the dies 55, 56 slip relative to each other and a gap is formed between the dies 55, 56.

Therefore, when the valve guide walls 51 and the connecting wall 52 are formed, metallic material may plastically flow and get into the gap formed between both the dies 55, 56, and the metallic material, which has plastically flowed in this way, may remain as molding flash in the portion corresponding to the corner angle portion of the side wall 51. The thus formed molding flash can not be removed in the finishing work conducted in the later process in some cases. Therefore, the thus formed molding flash is separated from the body during the use of the rocker arm and attached to parts arranged in the periphery.

SUMMARY OF THE INVENTION

To solve the above problem, the object of the invention is to provide a rocker arm in which the molding flash is not detached from the rocket arm and does not affects the peripheral parts.

In order to solve the aforesaid object, the invention is characterized by having the following arrangement.

Aspect 1. A rocker arm for opening and closing a valve comprising:

a body; and a valve engaging portion provided at the body, with which the valve is engaged, the valve engaging portion including, a pair of valve guide walls opposed to each other, a connecting wall connecting the pair of valve guide walls with each other, and a pair of excess thickness portions formed on the pair of valve guide walls, respectively, the pair of excess thickness portions being formed by portions of the pair of valve guide walls which plastically flow when the pair of valve guide walls are formed by dies, respectively.

Aspect 2. The rocker arm according to the aspect 1, wherein the connecting wall connects the pair of valve guide walls with each other in a first direction, and the pair of excess thickness portions are projected from the pair of valve guide wall in a second direction substantially perpendicular to the first direction, respectively.

Aspect 3. The rocker arm according to the aspect 2, wherein each of the pair of valve guide walls includes a side surface to which the connecting wall is connected, and a bottom surface substantially parallel to a bottom surface of the connecting wall, the pair of excess thickness portions are formed on the bottom surfaces of the pair of valve guide walls.

Aspect 4. The rocker arm according to the aspect 3, wherein the bottom surfaces of the pair of valve guide walls is projected from the bottom surface of the connecting wall in the second direction.

Aspect 5. The rocker arm according to the aspect 3, wherein the pair of excess thickness portions are extended along the bottom surfaces of the pair of valve guide walls in a third direction substantially perpendicular to the first and second directions.

Aspect 6. The rocker arm according to the aspect 3, wherein a width of each of the pair of excess thickness portions is set to be less than half and more than one-fifth of a width of the bottom surface of each of the pair of valve guide walls.

Aspect 7. A method of manufacturing a rocker arm for opening and closing a valve, the method comprising the steps of:

providing a metal sheet including a pair of predetermined valve guide wall regions opposed to each other and a predetermined connecting wall region connecting the pair of predetermined valve guide wall regions with each other;

pressing the pair of predetermined valve guide wall regions by a pair of first dies to approach each other in a first direction, respectively;

pressing and recess a center portion of the connecting wall region by a second die in a second direction substantially perpendicular to the first direction; and forming a pair of excess thickness portions from portions of the pair of predetermined guide wall regions which plastically flow into gaps provided between the first and second dies according to the pressing motion to press the pair of predetermined valve guide wall regions and according to the pressing motion to press the predetermined connecting wall region.

DETAILED DESCRIPTION OF PREFERRED EMBODIMENTS

Figure 1:
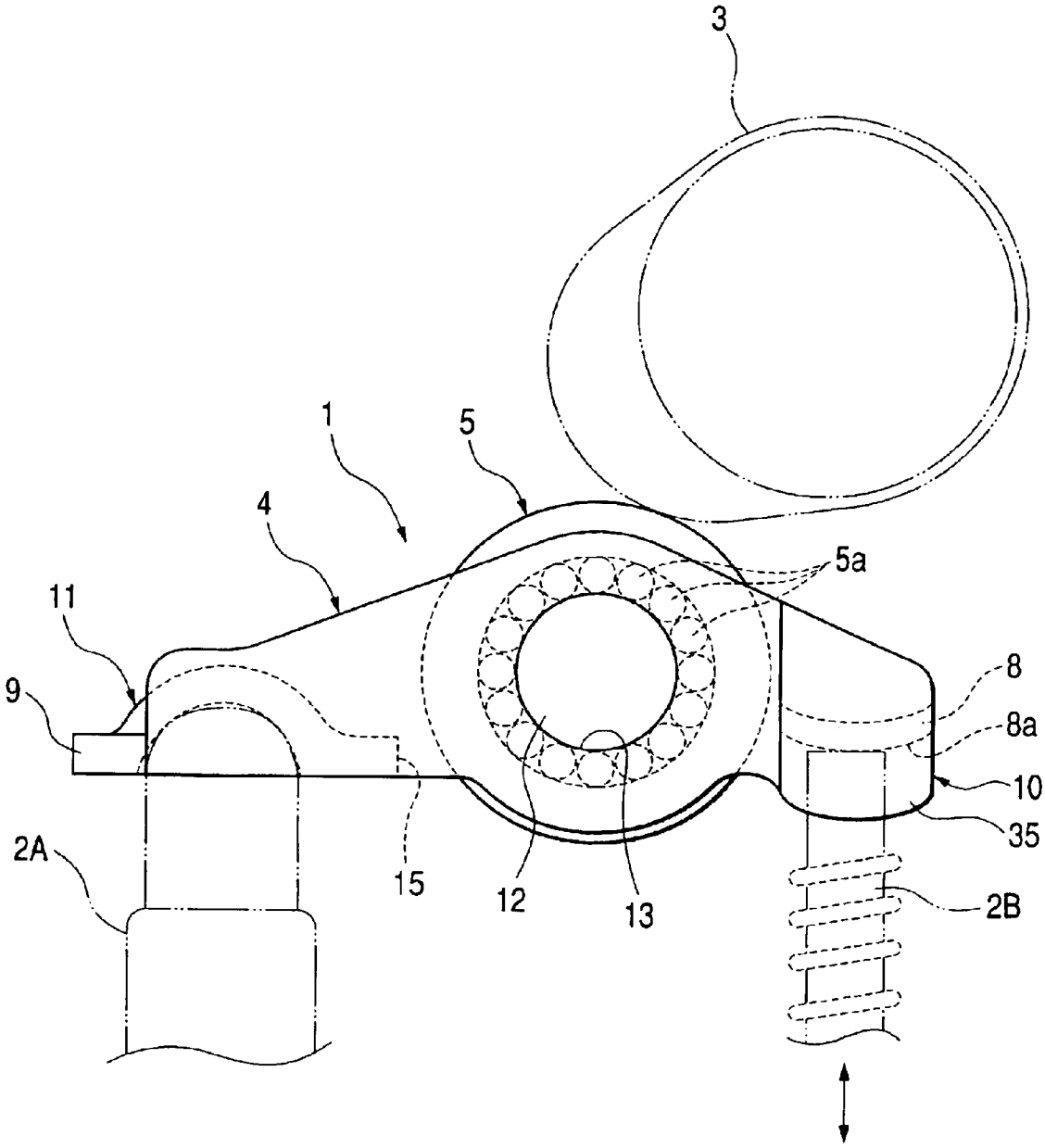
FIG. 1 is a side view showing a state of the use of the rocker arm of the embodiment of the present invention.
Figure 2:
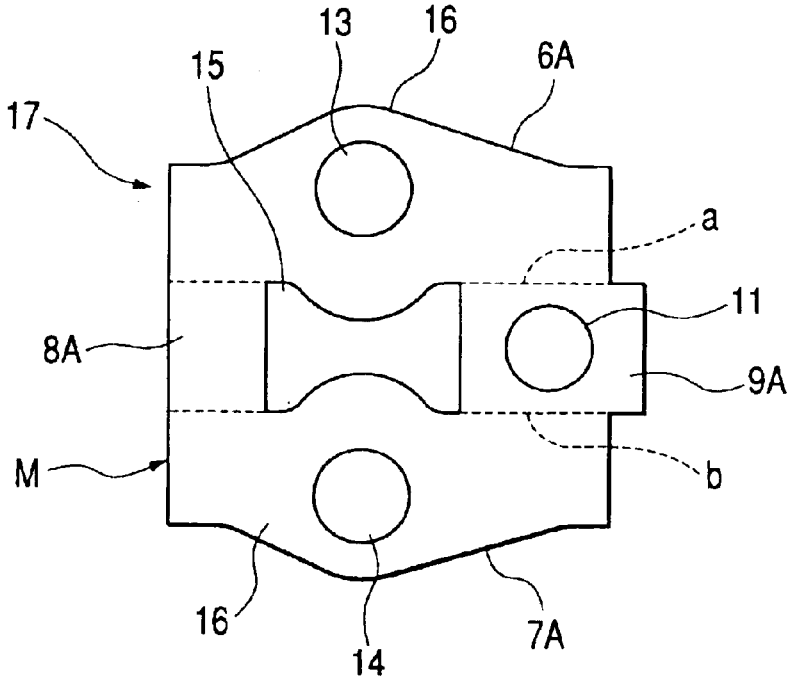
FIG. 2 is a plan view showing a first intermediate product in the case of manufacturing the rocker arm of the embodiment of the present invention.
Figure 3:
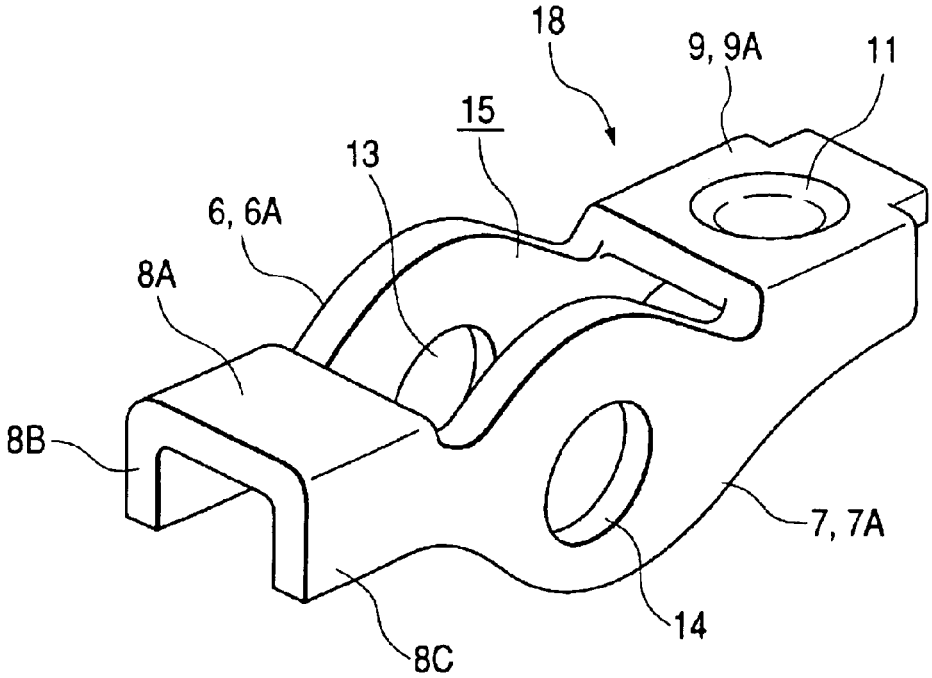
FIG. 3 is a perspective view showing a second intermediate product in the case of manufacturing the rocker arm of the embodiment of the present invention.
Figure 4:
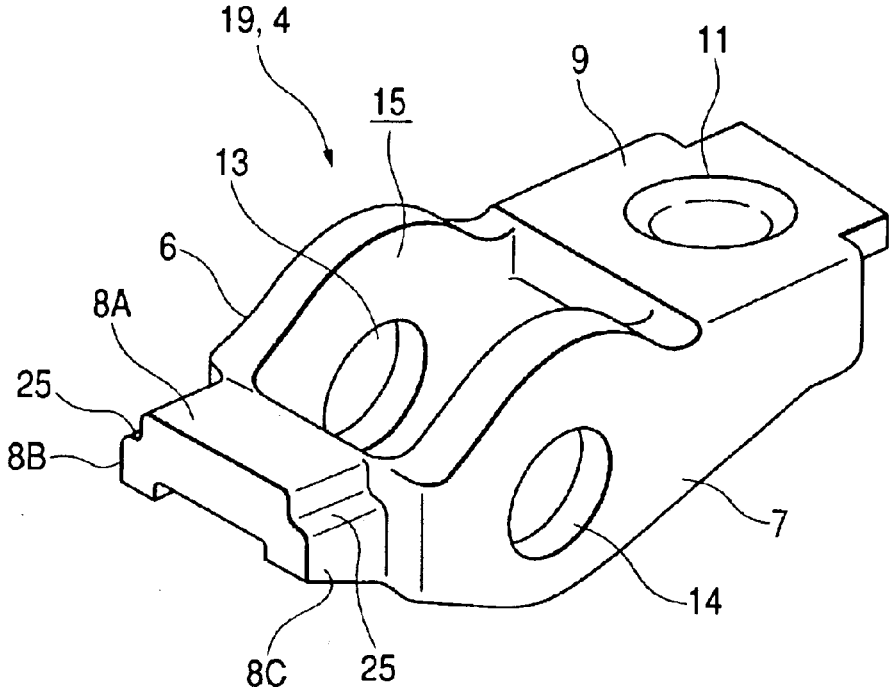
FIG. 4 is a perspective view showing a third intermediate product in the case of manufacturing the rocker arm of the embodiment of the present invention.
Figure 5:
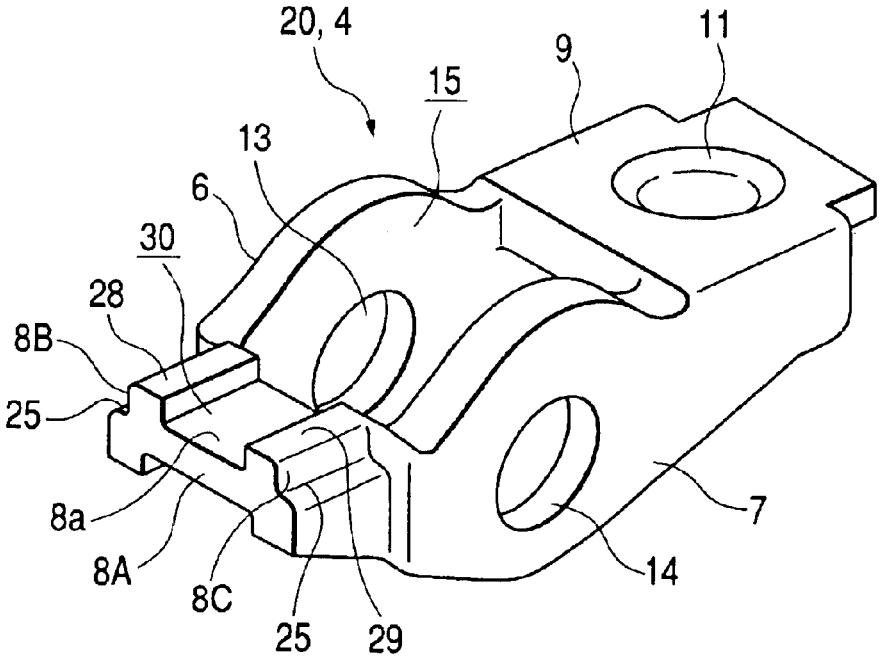
FIG. 5 is a perspective view showing a fourth intermediate product in the case of manufacturing the rocker arm of the embodiment of the present invention.
Figure 6:
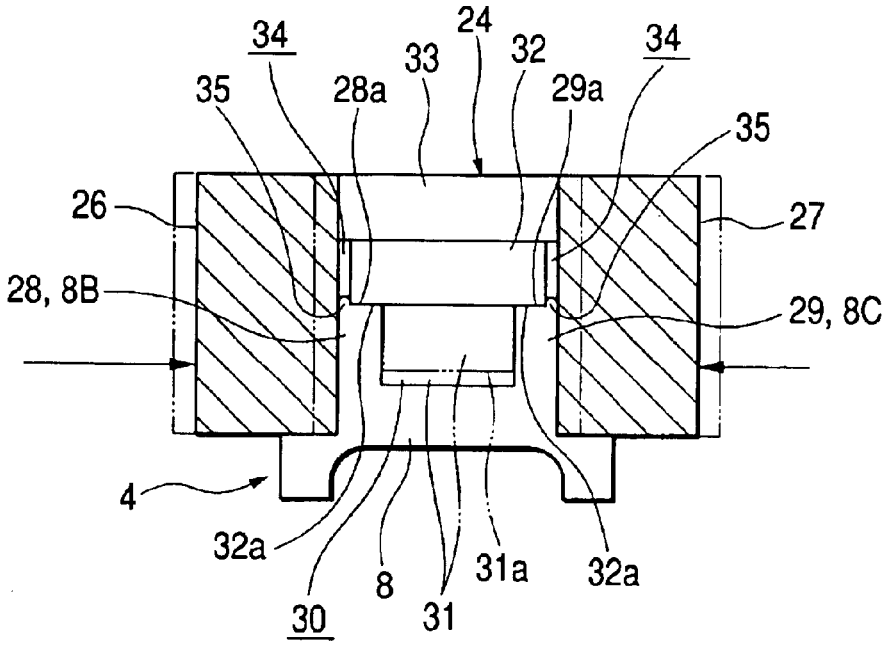
FIG. 6 is a process drawing of manufacturing a valve engaging portion of the rocker arm of the embodiment of the present invention.
Figure 7:
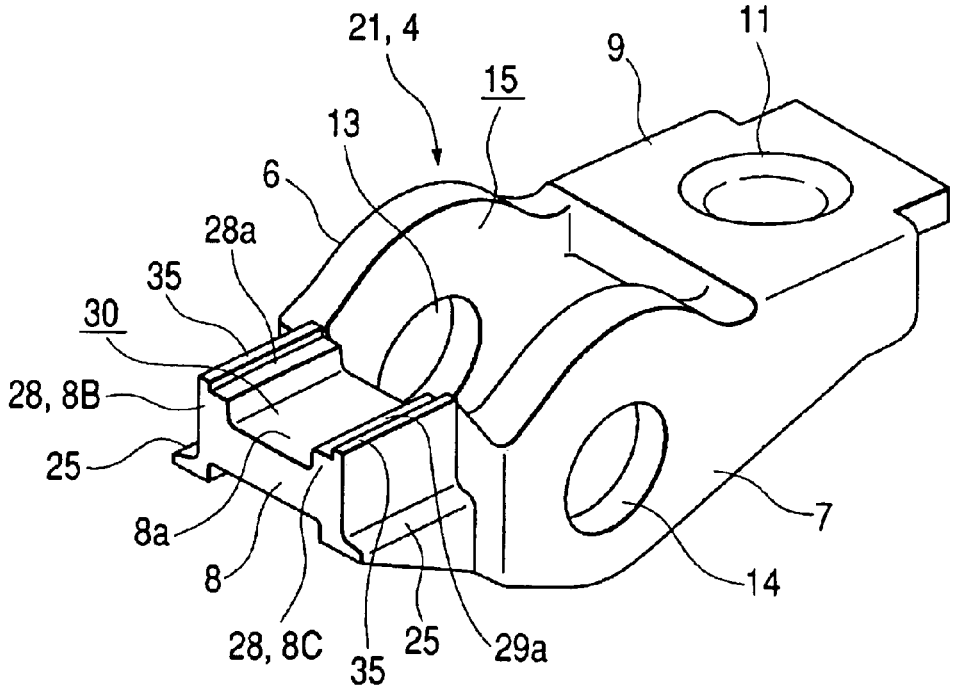
FIG. 7 is a perspective view showing a fifth intermediate product in the case of manufacturing the rocker arm of the embodiment of the present invention.
Figure 8A:
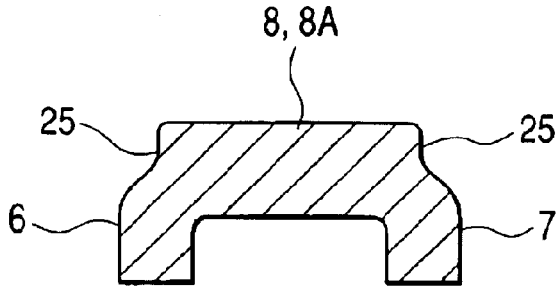
FIGS. 8A to 8C are views showing a change in the shape of the valve engaging portion in the manufacturing process.
Figure 8B:
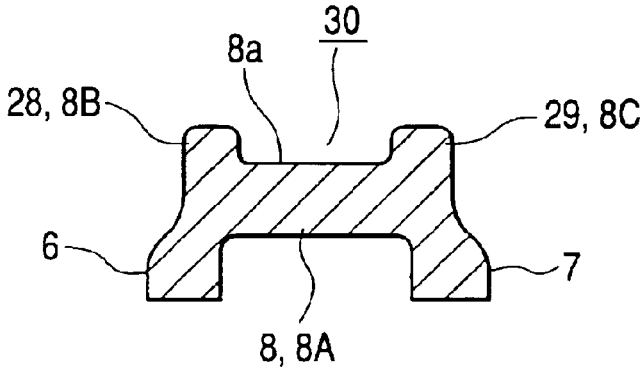
Figure 8C:
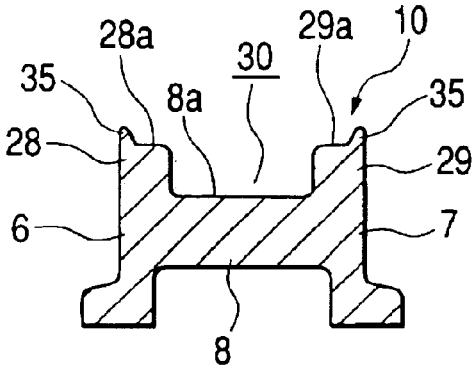
Figure 9:
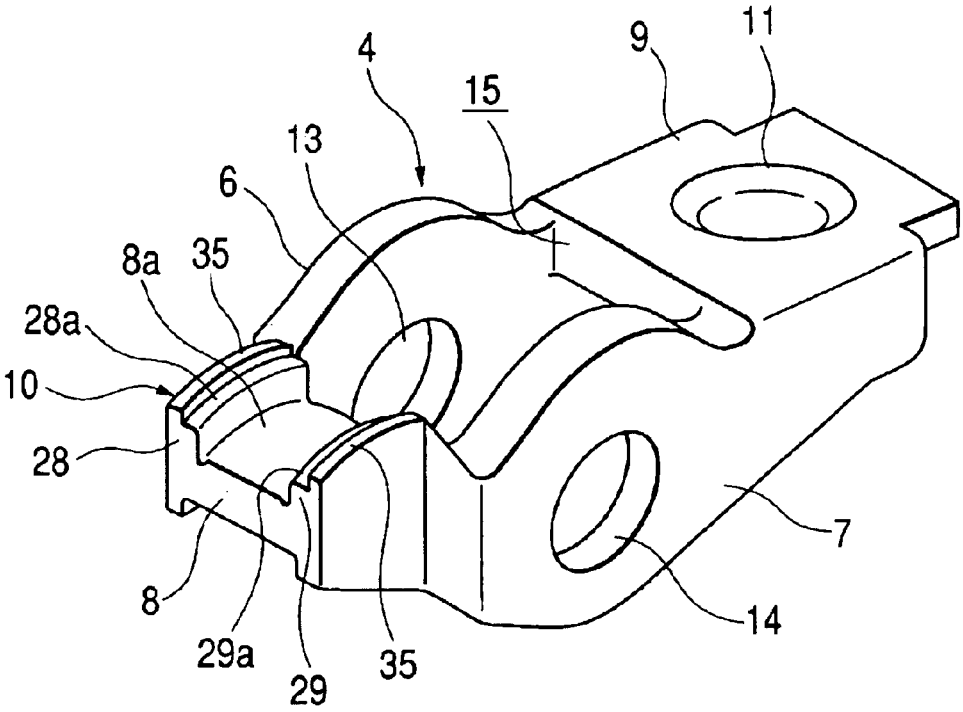
FIG. 9 is a perspective view of the body of the rocker arm that is a product.
Figure 10:
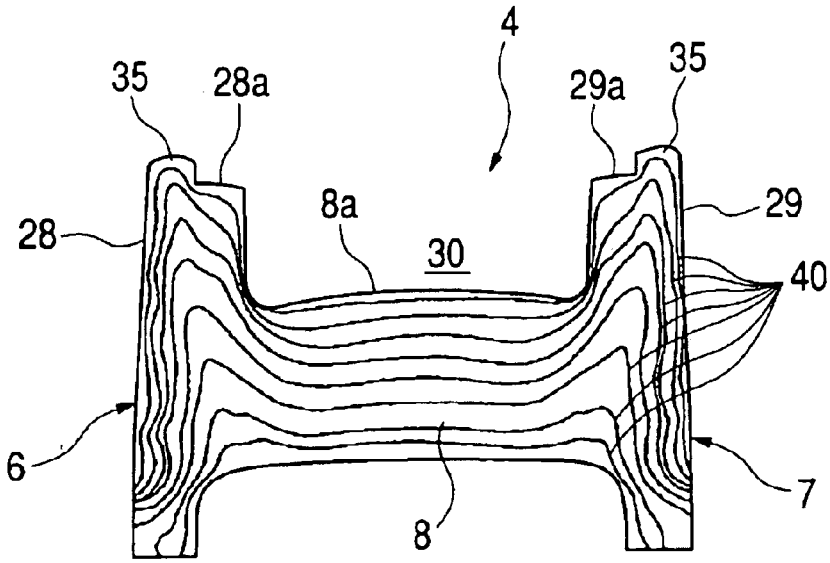
FIG. 10 is an enlarged view showing the continuity of a metal flow in the valve engaging portion.
Figure 11:
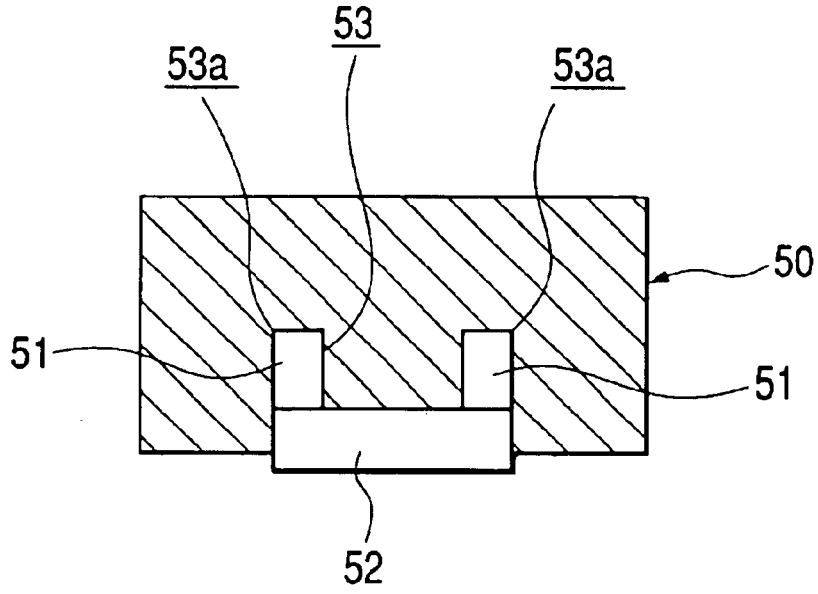
FIG. 11 is a front view showing a profile of a conventional die.
Figure 12:
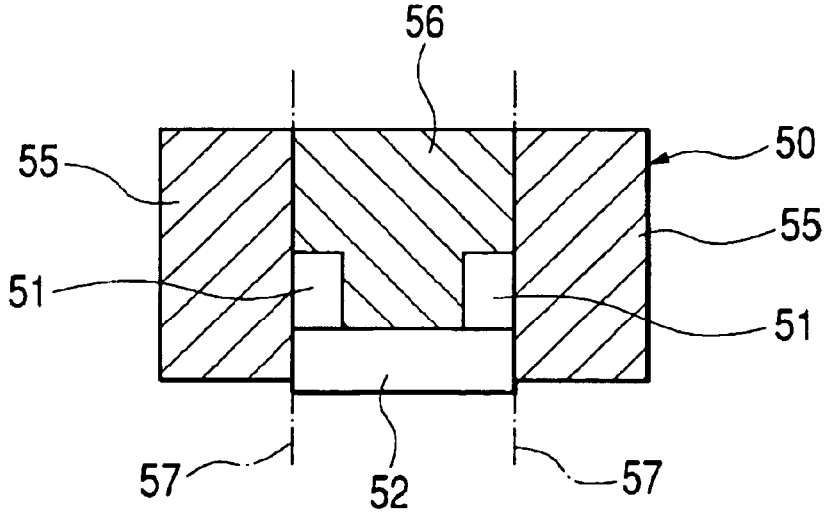
FIG. 12 is a front view showing a profile of another conventional die.

Referring to the drawings, the rocker arm of the present invention will be explained as follows. FIG. 1 is a side view showing a state of use of the rocker arm of the present invention, FIG. 2 is a plan view showing a first intermediate product in the case of manufacturing the rocker arm, FIG. 3 is a perspective view of the second intermediate product, FIG. 4 is a perspective view of the third intermediate product, FIG. 5 is a perspective view of the fourth intermediate product, FIG. 6 is a process drawing of manufacturing a valve engaging portion, FIG. 7 is a perspective view of the fifth intermediate product, FIGS. 8A to 8C are views showing a change in the shape of the valve engaging portion in the manufacturing process, FIG. 9 is a perspective view of the rocker arm that is a product, and FIG. 10 is an enlarged view showing the continuity of a metal flow in the valve engaging portion.

As shown in FIG. 1, this rocker arm 1 is of the end pivot type having the constitution in which the body 4 is tilted by the rotation of the cam 3 as one end side in the longitudinal direction of the rocker arm supported by the lash adjuster 2*a* serves as a fulcrum. According to the tilting motion of this rocker arm 1, a valve not shown in the drawing is opened and closed.

This rocker arm 1 includes the body 4 and the roller 5. This body 4 includes a pair of side walls 6, 7 which are opposed to each other in the axial direction of the roller 5. The body 4 further includes the connecting walls 8, 9 for connecting the side walls 6, 7 with each other, arranged on one end side and the other end side in the longitudinal direction. The body 4 further includes the valve engaging portion 10 arranged on one end side in the longitudinal direction. The body 4 further includes the pivot receiving portion 11 arranged on the other end side in the longitudinal direction. In the middle of the side walls 6, 7, there are formed insertion holes 13, 14 into which the support shaft 12 is inserted.

The valve engaging portion 10 includes the valve guide walls 28, 29 formed by deforming one portion of the side walls 6, 7, and the connecting wall 8. A continuous metal flow is formed among the valve guide walls 28, 29 and the connecting wall 8 in the valve engaging portion 10. The valve guide walls 28, 29 are used for guiding the valve stem 2B. On the bottom faces 28*a*, 29*a* of the valve guide walls 28, 29, the excess thickness portions 35 are formed. The connecting wall 9 on the other end side in the longitudinal direction has the aforementioned pivot receiving portion 11 for receiving an upper end portion of the lash adjuster 2.

The roller 5 is arranged in such a manner that one portion of the roller 5 is projected from the opening 15 formed in the bottom portion between the two connecting walls 8, 9 in the body 4. This roller 5 is pivotally supported by the support shaft 12 via a plurality of needle rollers 5*a*.

Next, the method of manufacturing the above rocker arm 1 is explained as follows. First of all, one metallic sheet (steel sheet) is punched by means for press forming to obtain a metallic sheet member M of a predetermined shape, at both side edges of which the arcuate portions 16 are provided. Next, the metallic sheet member M is punched so as to form the opening 15 at the substantial center. Therefore, the metallic sheet member M is formed into a shape having the predetermined side wall regions 6A, 7A and the predetermined connecting wall regions 8A, 9A.

A central region of the predetermined connecting wall region 9A on the other end side is subjected to drawing and formed into the hemispherical pivot receiving portion 11. Regions close to the arcuate portions 16 of this metallic sheet member M are punched into the insertion holes 13, 14. In this way, the first intermediate product 17 shown in FIG. 2 is provided.

Folding is conducted on the first intermediate product 17 at positions shown by the broken lines "a" and "b" in FIG. 2. In this way, the second intermediate product 18 shown in FIG. 3 is provided.

When folding has been conducted, this second intermediate product 18 is formed into a substantial U-shape when a view is taken from the front. This second intermediate product 18 includes: a pair of side walls 6, 7 which are arranged being opposed to each other in the axial direction; the predetermined connecting wall region 8A for connecting the predetermined valve guide wall regions 8B, 8C corresponding to one end side of both side walls 6, 7; and the connecting wall 9 for connecting the other end sides of the both side walls 6, 7. In this connection, when the first intermediate product 17 is machined into the second intermediate product 18, the predetermined connecting wall region 9A becomes the connecting wall 9 as it is.

Next, one portion of each of both side walls 6, 7 of the second intermediate product 18 machined as described above, that is, the predetermined valve guide wall regions 8B, 8C and the predetermined connecting wall region 8A are further machined and formed into the valve inserting portion 10.

A predetermined die is set so that the intermediate portions of both side walls 6, 7 in the longitudinal direction of the above second intermediate product 18 can be restricted, and portions corresponding to the lower side of the predetermined valve guide wall regions 8B, 8C are pushed from both sides toward the inside (in the cross direction) by the first dies 26, 27 (shown in FIG. 6), the cross sections of which are formed into a substantial rectangle. Therefore, the predetermined connecting wall region 8A is compressed and formed in the cross direction. Due to the above compressive forming, the step-like side portions 25 are formed in the predetermined valve guide wall regions 8B, 8C. According to that, the wall thickness of the predetermined connecting wall region 8A is increased, and the third intermediate product 19 shown in FIG. 4 can be provided. When necessary, softening annealing is conducted on the third intermediate product 19 so as to remove the internal stress.

Next, while the predetermined valve guide wall regions 8B, 8C are being pushed by the first dies 26, 27, the second die 24 for forming a groove, which is different from the first dies 26, 27, is pushed at the intermediate positions on the lower face side of the predetermined valve guide wall regions 8B, 8C, that is, the second die 24 for forming a groove is pushed at the predetermined connecting wall region 8A, so that a central region on the lower face side of the predetermined connecting wall region 8A is deformed being recessed upward (in the height direction). Therefore, both sides of the recessed portion, that is, the predetermined valve guide wall regions 8B, 8C are made to plastically flow downward so that the height can be increased, and the groove 30 is formed by the predetermined connecting wall region 8A and the predetermined valve guide wall regions 8B, 8C. In this way, the fourth intermediate product 20 shown in FIG. 5 is provided.

In this connection, as shown in FIG. 6, the second die 24 is formed into a step-like shape in which the width in the axial direction is reduced on the forward end side. Therefore, the forward end portion 31 of the second die 24 is used for engaging between the predetermined valve guide wall regions 8B, 8C so that the groove 30 (the forward end portion 31) can be formed. The width of the intermediate portion 32 of the second die 24 is smaller than the width between the sides of the predetermined valve guide wall regions 8B, 8C. The width of the base end portion 33 of the second die 24 is set to be the same as the width between the sides 28, 29 of the valve guide walls 28, 29.

Accordingly, with the constitution of the first dies 26, 27 and the second die 24, in the state that the first dies 26, 27 and the second die 24 are set to each other in the axial direction, the gaps 34 for forming the excess thickness portion is provided between the first dies 26, 27 and the intermediate portion 32 of the second die 24.

Successively, while the predetermined valve guide wall regions 8B, 8C are being pushed by the first dies 26, 27, the central region on the lower face side of the predetermined connecting wall region 8A is further deformed being recessed upward by the second die 24. At this time, the forward end face 32*a* of the intermediate portion 32 of the second die 24 pushes the bottom faces 28*a*, 29*a* of the predetermined valve guide wall regions 8B, 8C.

The second die 24 is further pushed and the predetermined connecting wall region 8A is gradually moved upward. In this way, while the depth of the groove 30 is being gradually increased so that the predetermined connecting wall region 8A can be located at a predetermined position in the middle in the height direction of the predetermined valve guide wall regions 8B, 8C, the height of the predetermined valve guide wall regions 8B, 8C is gradually increased. Then, the forward end face 32*a* of the intermediate portion 32 of the second die 24 pushes the bottom faces 28*a*, 29*a* of the valve guide walls 28, 29.

Then, as shown in FIG. 6, one portion of the bottom portions of the predetermined valve guide wall regions 8B, 8C plastically flows into the gap 34 for forming an excess thickness portion on which no restrictions are placed. Therefore, when the first dies 26, 27 and the second die 24 are detached from the body 4, as shown in FIG. 7, metallic material, which has plastically flowed, remains on the bottom faces 28*a*, 29*a* of the predetermined valve guide wall regions 8B, 8C as the excess thickness portion 35, the size of which is larger than that of the conventional molding flash. FIG. 7 is a view showing the fifth intermediate product 21. FIGS. 8A to 8C show a change in the cross section of the valve engaging portion 10 in the process of machining.

In this connection, the reason why machining in the cross direction and machining for forming the groove are successively conducted by a plurality of times is to prevent the metal flow 40, which flows between the valve guide walls 28, 29 (both side walls 6, 7) and the connecting wall 8, from being cut off.

Finally, after the machining in the cross direction has been conducted so that the step-shaped side portion 25 can disappear, the final groove forming is conducted by using a pushing punch for finishing not shown in the drawing in such a manner that the bottom face 8*a* of the predetermined connecting wall region 8A is formed into a curved face having a predetermined radius of curvature. Therefore, the predetermined connecting wall region 8A becomes the connecting wall 8, and the predetermined valve guide wall regions 8B, 8C become the valve guide walls 28, 29. In this way, the body 4 having the valve engaging portion 10, the depth of which is sufficiently large, is provided as shown in FIGS. 1 to 9.

As described above, since the first dies 26, 27 and the second die 24, which is separated from the first dies 26, 27, are provided in the case of machining the valve engaging portion 10, it is possible to avoid the occurrence of a case in which stress concentration is caused in one portion of the die and the life of the die is shortened like the conventional die.

The gap 34 for forming the excess thickness portion is provided between the first dies 26, 27 and the intermediate portion 32 of the second die 24, and the excess thickness portion 35, which is attached to the valve guide walls 28, 29, the size of which is larger than that of the conventional molding flash and the mechanical strength of which is higher than that of the conventional molding flash, is formed in the valve guide walls 28, 29. This excess thickness portion 35 is not removed by means of shot peening or cleaning conducted by the barrel device after the formation of the body 4. Even when the rocker arm 1 is used, this excess thickness portion is not disengaged from the valve guide walls 28, 29.

Incidentally, in the embodiment, a width of each the excess thickness portion 35 is set to be less than half and more than one fifth of a width of each bottom surface 28*a*, 29*a*.

Accordingly, it is possible to avoid the occurrence of a conventional case in which the molding flash formed by the gap generated on the dividing line (parting line) of the dies comes out from the rocker arm 1 and drops to the peripheral parts when the rocker arm 1 is being used.

When the valve engaging portion 10 is formed, a pushing force given to the first dies 26, 27 and the second die 24 is adjusted in the process of machining in the cross direction and forming a groove, and the machining is conducted by a plurality of times. Therefore, as shown in FIG. 10, it is possible to prevent the metal flow 40 between both side walls 6, 7 and the connecting wall 8 from being cut off. Therefore, it is possible to ensure the rigidity of the valve engaging portion 10, and the rocker arm 1 of stable quality can be provided.

As can be understood from the above explanations, according to the present invention, when the excess thickness portion is formed in the valve engaging portion, it is possible to solve the conventional problems in which the molding flash formed by the gap generated on the parting line of the dies is detached from the rocker arm and affects the peripheral parts.

What is claimed is:

1. A rocker arm for opening and closing a valve, comprising:

a valve engaging portion for engaging the valve, said valve engaging portion comprising:

a pair of valve guide walls opposed to each other; and a pair of excess thickness portions formed on said pair of valve guide walls respectively.

2. The rocker arm according to claim 1, wherein said excess thickness portions are integrally formed with said valve guide walls.

3. The rocker arm according to claim 1, comprising:

a pivot receiving portion formed on an opposite end of said rocker arm from said valve engaging portion.

4. A method of manufacturing a rocker arm for opening and closing a valve, the method comprising:

providing a metal sheet including a pair of predetermined valve guide wall regions opposed to each other and a predetermined connecting wall region connecting the pair of predetermined valve guide wall regions with each other;

pressing the pair of predetermined valve guide wall regions by a pair of first dies to approach each other in a first direction, respectively; and forming a pair of excess thickness portions from portions of the pair of predetermined guide wall regions.

5. The method according to claim 4, comprising:

pressing and recessing a center portion of the connecting wall region by a second die in a second direction substantially perpendicular to the first direction to form a pair of step side portions to increase the thickness of the connecting wall.

6. The method according to claim 5, while said connecting wall is being pressed and depressed, said valve guide wall regions are caused to plastically flow downward to form a groove between said valve guide wall regions.

7. The method according to claim 6, further comprising:

upwardly forcing said connecting wall to increase a depth of said groove such that said connecting wall is positioned centrally between said valve guide walls and such that a height of said valve guide walls is increased.

8. The method according to claim 4, wherein said pair of excess thickness portions are formed from portions of the pair of predetermined guide wall regions which plastically flow into gaps provided between the first and second dies according to the pressing motion to press the pair of predetermined valve guide wall regions and to press the predetermined connecting wall region.

9. The method according to claim 4, wherein said excess thickness portion are integrally formed with said valve guide walls.

10. A rocker arm for opening and closing a valve comprising:

a body; and a valve engaging portion provided at the body, with which the valve is engaged, the valve engaging portion comprising:

a pair of valve guide walls opposed to each other;

a connecting wall connecting the pair of valve guide walls with each other; and a pair of excess thickness portions formed on the pair of valve guide walls, respectively, wherein said excess thickness portions are integrally formed with said valve guide walls; and a pivot receiving portion formed on an opposite end of said rocker arm from said valve engaging portion.

11. The rocker arm according to claim 10, wherein the connecting wall connects the pair of valve guide walls with each other in a first direction, and wherein the pair of excess thickness portions are projected from the pair of valve guide walls in a second direction substantially perpendicular to the first direction, respectively.

12. The rocker arm according to claim 11, wherein each of the pair of valve guide walls comprises:

a side surface to which the connecting wall is connected; and a bottom surface substantially parallel to a bottom surface of the connecting wall, wherein the pair of excess thickness portions are formed on the bottom surfaces of the pair of valve guide walls.

13. The rocker arm according to claim 12, wherein the bottom surfaces of the pair of valve guide walls is projected from the bottom surface of the connecting wall in the second direction.

14. The rocker arm according to claim 12, wherein the pair of excess thickness portions are extended along the bottom surfaces of the pair of valve guide walls in a third direction substantially perpendicular to the first and second directions.

15. The rocker arm according to claim 12, wherein a width of each of the pair of excess thickness portions is set to be less than half or more than one-fifth of a width of the bottom surface of each of the pair of valve guide walls.

16. The rocker arm according to claim 12, wherein a width of each of the pair of excess thickness portions is at least one-fifth of a width of the bottom surface of each of the pair of walls.

17. The rocker arm according to claim 10, wherein the pair of excess thickness portions are formed by portions of the pair of valve guide walls which plastically flow when the pair of valve guide walls are formed by dies.

18. A method of manufacturing a rocker arm for opening and closing a valve, the method comprising:

providing a metal sheet including a pair of predetermined valve guide wall regions opposed to each other and a predetermined connecting wall region connecting the pair of predetermined valve guide wall regions with each other;

pressing the pair of predetermined valve guide wall regions by a pair of first dies to approach each other in a first direction, respectively;

pressing and recessing a center portion of the connecting wall region by a second die in a second direction substantially perpendicular to the first direction; and forming a pair of excess thickness portions from portions of the pair of predetermined guide wall regions which plastically flow into gaps provided between the first and second dies according to the pressing motion to press the pair of predetermined valve guide wall regions and according to the pressing motion to press the predetermined connecting wall region.

19. The method according to claim 18, wherein said excess thickness portions are integrally formed with said valve guide walls.

20. The method according to claim 18, further comprising:

forming a pivot receiving portion on an opposite end of said rocker arm from said valve engaging portion.

* * * * *